US008267061B2

(12) United States Patent
Moriya et al.

(10) Patent No.: US 8,267,061 B2
(45) Date of Patent: Sep. 18, 2012

(54) ENGINE STARTING DEVICE AND ENGINE STARTING METHOD

(75) Inventors: Kouki Moriya, Aichi-gun (JP); Jumpei Kakehi, Toyota (JP); Hasrul Sany Bin Hashim, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/184,997

(22) Filed: Jul. 18, 2011

(65) Prior Publication Data

US 2012/0017863 A1 Jan. 26, 2012

Related U.S. Application Data

(63) Continuation of application No. PCT/JP2010/062204, filed on Jul. 21, 2010.

(51) Int. Cl.
*F02N 11/00* (2006.01)

(52) U.S. Cl. ..... 123/179.3; 123/179.25; 123/179.28

(58) Field of Classification Search ..... 701/110, 701/111, 113; 123/179.3, 179.4, 179.18, 123/179.25, 179.28
See application file for complete search history.

(56) References Cited

U.S. PATENT DOCUMENTS

| | | | | |
|---|---|---|---|---|
| 7,093,512 | B2 * | 8/2006 | Ibamoto et al. | 74/339 |
| 2010/0116235 | A1 * | 5/2010 | Imamura et al. | 123/179.3 |
| 2010/0242905 | A1 * | 9/2010 | Machida et al. | 123/339.14 |

FOREIGN PATENT DOCUMENTS

| | | |
|---|---|---|
| EP | 2 159 410 A2 | 3/2010 |
| JP | A-2001-073911 | 3/2001 |
| JP | A-2002-115631 | 4/2002 |
| JP | A-2005-030348 | 2/2005 |
| JP | A-2005-330813 | 12/2005 |
| JP | A-2009-529114 | 8/2009 |
| JP | A-2010-031851 | 2/2010 |
| WO | WO 2007/101770 A1 | 9/2007 |

OTHER PUBLICATIONS

Oct. 5, 2010 International Search Report issued in PCT/JP2010/062092, with translation.

Oct. 5, 2010 International Search Report issued in PCT/JP2010/062204, with translation.

U.S. Appl. No. 13/144,999 in the name of Kouki Moriya et al., filed Jul. 18, 2011.

* cited by examiner

*Primary Examiner* — Hai Huynh
(74) *Attorney, Agent, or Firm* — Oliff & Berridge, PLC

(57) ABSTRACT

An ECU executes a program including the steps of selecting an engagement mode when start of an engine is requested and when an engine speed is smaller than α1; selecting a full drive mode; selecting a stand-by mode when start of the engine is completed; selecting a rotation mode when the engine speed is equal to or smaller than α2 and greater than α1, and selecting the full drive mode when fluctuation is predicted even when a difference Ndiff between rotation of a ring gear and rotation of a pinion gear is greater than a predetermined value β2.

12 Claims, 6 Drawing Sheets

ENGINE STARTING DEVICE AND ENGINE STARTING METHOD

This is a Continuation of PCT Application No. PCT/JP2010/062204 filed Jul. 21, 2010. The entire contents of which are hereby incorporated by reference.

BACKGROUND OF THE INVENTION

1. Field of the Invention

The present invention relates to an engine starting device and an engine starting method and particularly to a starter control technique with which an actuator for moving a pinion gear so as to be engaged with a ring gear provided around an outer circumference of a flywheel of the engine and a motor for rotating the pinion gear are individually controlled.

2. Description of the Background Art

In recent years, in order to improve fuel efficiency or reduce exhaust emission, some cars having an internal combustion engine such as an engine include what is called an idling-stop function, in which an engine is automatically stopped while a vehicle stops and a driver operates a brake pedal, and the vehicle is automatically re-started, for example, by a driver's operation for re-start such as decrease in an amount of operation of a brake pedal to zero.

In this idling-stop, the engine may be re-started while an engine speed is relatively high. In such a case, with a conventional starter in which pushing-out of a pinion gear for rotating the engine and rotation of the pinion gear are caused by one drive command, the starter is driven after waiting until the engine speed sufficiently lowers, in order to facilitate engagement between the pinion gear and a ring gear of the engine. Then, a time lag is caused between issuance of a request to re-start an engine and actual engine cranking, and the driver may feel uncomfortable.

In order to solve such a problem, Japanese Patent Laying-Open No. 2005-330813 (Patent Document 1) discloses a technique for causing a pinion gear to perform a rotational operation with the use of a starter configured such that a pinion gear engagement operation and a pinion gear rotational operation can independently be performed prior to the pinion gear engagement operation when a re-start request is issued while rotation of an engine is being lowered immediately after a stop request is generated and for re-starting the engine by causing the pinion gear engagement operation when a pinion gear rotation speed is in synchronization with an engine speed.

SUMMARY OF THE INVENTION

If the engine speed suddenly fluctuates in an example where the pinion gear engagement operation is performed when the pinion gear rotation speed and the engine speed are in synchronization as in the technique described in Japanese Patent Laying-Open No. 2005-330813, however, it becomes difficult to synchronize the pinion gear rotation speed and the engine speed with each other and starting capability of the engine becomes poor.

The present invention was made to solve the above-described problems, and an object of the present invention is to provide an engine starting device and an engine starting method for suppressing deterioration in starting capability of an engine.

An engine starting device according to one aspect of the present invention includes a starter for starting an engine and a control device for the starter. The starter includes a second gear that can be engaged with a first gear coupled to a crankshaft of the engine, an actuator for moving the second gear to a position of engagement with the first gear in a driven state, and a motor for rotating the second gear. The control device is capable of individually driving each of the actuator and the motor. The control device has a rotation mode in which the motor is driven prior to drive of the actuator and an engagement mode in which the actuator is driven so as to engage the second gear with the first gear prior to drive of the motor. The control device makes transition to the engagement mode when load of the engine fluctuates while the rotation mode is being executed.

Preferably, the control device drives the actuator when the load of the engine fluctuates after start of actuation of the motor and before an estimation time point when it is estimated that rotation of the first gear and rotation of the second gear are in synchronization with each other, while the rotation mode is being executed.

Further preferably, the control device drives the actuator when a prediction condition that fluctuation of a rotation speed of the engine is predicted is satisfied after start of actuation of the motor and before an estimation time point when it is estimated that rotation of the first gear and rotation of the second gear are in synchronization with each other, while the rotation mode is being executed.

Further preferably, equipment causing fluctuation of the load of the engine as a result of actuation is coupled to the crankshaft of the engine. The prediction condition is a condition that a command for changing an actuated state of the equipment has been received.

Further preferably, the equipment is a clutch. The prediction condition is a condition that a command for changing an actuated state of the clutch has been received.

Further preferably, the prediction condition is a condition that an operation for changing the clutch from a disengaged state to an engaged state has been received.

Further preferably, the equipment is a transmission. The prediction condition is a condition that a command for changing a transmitting state of the transmission has been received.

Further preferably, the prediction condition is a condition that an operation for selecting a gear position of the transmission has been received.

Further preferably, the equipment is an alternator. The prediction condition is a condition that any one command of a command for actuating the alternator and a command for stopping actuation of the alternator has been received.

Further preferably, the equipment is an air-conditioner compressor. The prediction condition is a condition that any one command of a command for actuating the air-conditioner compressor and a command for stopping actuation of the air-conditioner compressor has been received.

Further preferably, the control device controls the actuator and the motor such that the engine starts, with any one of the rotation mode and the engagement mode being selected based on a rotation speed of the engine.

In an engine starting method according to another aspect of the present invention, an engine is provided with a starter for starting the engine and a control device for the starter. The starter includes a second gear that can be engaged with a first gear coupled to a crankshaft of the engine, an actuator for moving the second gear to a position of engagement with the first gear in a driven state, and a motor for rotating the second gear. Each of the actuator and the motor can individually be driven. The starting method includes the steps of: driving the actuator and the motor in a rotation mode in which the motor is driven prior to drive of the actuator; driving the actuator and the motor in an engagement mode in which the actuator is driven so as to engage the second gear with the first gear prior to drive of the motor; and making transition to the engagement mode when load of the engine fluctuates while the rotation mode is being executed.

According to the present invention, if load of the engine fluctuates after the motor is driven and before the estimation time point when it is estimated that rotation of the ring gear of the engine and rotation of the pinion gear of the starter are in synchronization with each other while the rotation mode is being executed, the actuator is driven so that the first gear and the second gear are engaged with each other. Thus, even when an engine speed Ne suddenly fluctuates, the engine can quickly be started and hence deterioration in starting capability can be suppressed. Therefore, an engine starting device and an engine starting method for suppressing deterioration in engine starting capability can be provided.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
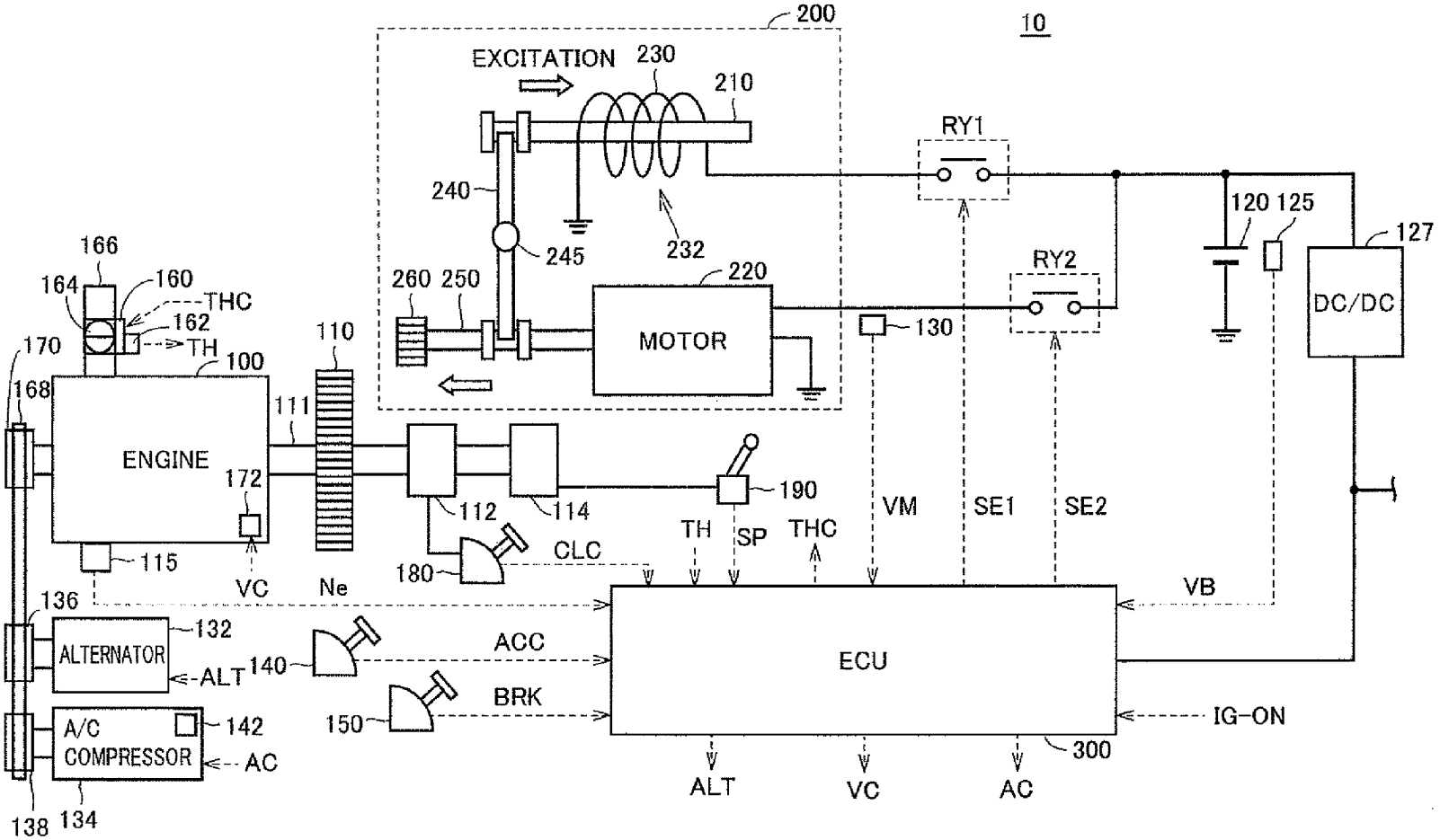
FIG. 1 is an overall block diagram of a vehicle.

An embodiment of the present invention will be described hereinafter with reference to the drawings. In the description below, the same elements have the same reference characters allotted. Their label and function are also identical. Therefore, detailed description thereof will not be repeated.

First Embodiment

Structure of Engine Starting Device

FIG. 1 is an overall block diagram of a vehicle 10. Referring to FIG. 1, vehicle 10 includes an engine 100, a battery 120, a starter 200, a control device (hereinafter also referred to as an ECU) 300, and relays RY1, RY2. Starter 200 includes a motor 220, an actuator 232, a coupling portion 240, an output member 250, and a pinion gear 260. Actuator 232 includes a plunger 210 and a solenoid 230. An engine starting device according to the present embodiment includes starter 200 for starting the engine and ECU 300 serving as the control device for starter 200.

Engine 100 generates driving force for running vehicle 10. A crankshaft 111 serving as an output shaft of engine 100 is connected to a drive wheel, with a powertrain structured to include a clutch 112, a transmission 114, a reduction gear, or the like being interposed.

Engine 100 is provided with an intake passage 166 for supplying air to engine 100. Intake passage 166 is provided with a throttle valve 164 for regulating a flow rate of air flowing through intake passage 166. Throttle valve 164 is actuated by a throttle motor 160. Throttle motor 160 is driven based on a control signal THC from ECU 300. A position of throttle valve 164, that is, a throttle position, is detected by a throttle position sensor 162. Throttle position sensor 162 outputs a detection value TH to ECU 300.

Engine 100 may be provided with a valve drive actuator 172 for driving an intake valve and an exhaust valve. Valve drive actuator 172 may be an actuator for adjusting each valve opening, for example, by directly driving the intake valve and the exhaust valve, or an actuator for changing timing to close the intake valve and the exhaust valve and a lift amount thereof. Valve drive actuator 172 is driven based on a control signal VC from the ECU.

Engine 100 is provided with a rotation speed sensor 115. Rotation speed sensor 115 detects a speed Ne of engine 100 and outputs a detection result to ECU 300.

Battery 120 is an electric power storage element configured such that it can be charged and can discharge. Battery 120 is configured to include a secondary battery such as a lithium ion battery, a nickel metal hydride battery, a lead-acid battery, or the like. Alternatively, battery 120 may be implemented by a power storage element such as an electric double layer capacitor.

In addition, equipment causing fluctuation of load of engine 100 as it is actuated is coupled to crankshaft 111 of engine 100. In the present embodiment, the equipment causing fluctuation of the load of engine 100 includes clutch 112, transmission 114, an alternator 132, and an air-conditioner compressor 134. It is noted that the equipment causing fluctuation of the load of engine 100 may include a pump for generating a hydraulic pressure of a power steering actuated by motive power of engine 100 in response to a control signal from ECU 300 or throttle valve 164 of engine 100, instead of or in addition to clutch 112, alternator 132, and air-conditioner compressor 134 described above.

A pulley 136 is provided on an input shaft of alternator 132. In addition, a pulley 138 is provided on an input shaft of air-conditioner compressor 134. A pulley 168 is provided on crankshaft 111 of engine 100. Pulleys 136, 138 and 168 are coupled to one another by a belt 170. Therefore, torque of crankshaft 111 of engine 100 is transmitted to pulley 168 and to pulleys 136 and 138 through belt 170.

Alternator 132 generates electric power by using torque transmitted to pulley 136, by exciting a contained electromagnetic coil, based on a control signal ALT from ECU 300. Alternator 132 charges battery 120 by supplying generated electric power to battery 120 through an inverter, a converter or the like that is not shown. It is noted that alternator 132 may charge battery 120 by supplying electric power generated by alternator 132 to battery 120 through a not-shown inverter and a DC/DC converter 127. An amount of electric power generation by alternator 132 is controlled by ECU 300.

Air-conditioner compressor 134 is actuated based on a control signal AC from ECU 300. Air-conditioner compressor 134 contains an electromagnetic clutch 142. Electromagnetic clutch 142 is in an engaged state or in a disengaged state, based on control signal AC from ECU 300.

When electromagnetic clutch 142 is in the engaged state, torque transmitted from crankshaft 111 to pulley 138 through belt 170 is transmitted to the input shaft of air-conditioner compressor 134. Therefore, as pulley 138 and the input shaft of air-conditioner compressor 134 integrally rotate, air-conditioner compressor 134 is actuated.

Alternatively, when electromagnetic clutch 142 is in the disengaged state, torque transmitted from crankshaft 111 to pulley 138 through belt 170 is not transmitted to the input shaft of air-conditioner compressor 134. Therefore, in this case, only pulley 138 out of pulley 138 and the input shaft of air-conditioner compressor 134 rotates.

Clutch 112 and transmission 114 are coupled to engine 100. Clutch 112 is provided between engine 100 and transmission 114. Clutch 112 is changed from any one state of the engaged state and the disengaged state to the other state. When clutch 112 is in the engaged state, motive power of engine 100 is transmitted to transmission 114 via clutch 112. On the other hand, when clutch 112 is in the disengaged state, transmission of motive power between engine 100 and transmission 114 is cut off and hence motive power of engine 100 is not transmitted to transmission 114.

In the present embodiment, clutch 112 is a dry clutch and its actuated state is varied in response to a driver's operation of a clutch pedal 180. An initial state of clutch 112 corresponding to an initial state (a non-operated state) of clutch pedal 180 is the engaged state. For example, when the driver presses down clutch pedal 180, clutch 112 enters the disengaged state using the driver's operation force. Then, when the driver releases pressing-down of clutch pedal 180, clutch 112 returns to the initial state (engaged state) using elastic force of an elastic member (such as a diaphragm spring) provided in clutch 112. It is noted that clutch 112 may switch any of the disengaged state and the engaged state from one state to the other, for example, by using an actuator. Here, the actuator changes the actuated state of clutch 112 in response to reception of a command for changing the actuated state of clutch 112 from ECU 300.

Clutch pedal 180 is provided with a clutch pedal position sensor (not shown). The clutch position sensor outputs a signal CLC indicating an amount of operation of clutch pedal 180 to ECU 300.

For example, when clutch pedal 180 is pressed down to such an extent that an amount of operation of clutch pedal 180 is equal to or greater than a predetermined operation amount, the clutch position sensor may output an ON signal to ECU 300, and when pressing-down is decreased to such an extent that the operation amount is smaller than the predetermined operation amount, it may stop output of the ON signal or output an OFF signal. Alternatively, when clutch pedal 180 is pressed down to such an extent that an amount of operation of clutch pedal 180 is equal to or greater than a first operation amount, the clutch position sensor may output the ON signal to ECU 300, and when pressing-down is released to such an extent that the operation amount is equal to or smaller than a second operation amount on a pressing-down release side relative to the first operation amount, it may stop output of the ON signal or output the OFF signal.

In the present embodiment, though description is given assuming that transmission 114 is implemented, for example, by a manual transmission, it is not particularly limited to the manual transmission. Transmission 114 may be an automatic transmission which selects any gear position among a plurality of gear positions by using the actuator. Here, the actuator selects a gear position corresponding to a command in response to reception of the command for selecting a gear position from ECU 300.

A gear position of transmission 114 is selected by using a shift lever 190. Shift lever 190 is provided with a shift position sensor (not shown). The shift position sensor outputs a signal SP indicating a position of shift lever 190 to ECU 300.

For example, signal SP indicating a position of shift lever 190 includes information indicating each amount of travel from a neutral position (an initial position in a non-operated state) with regard to a shift direction and a select direction orthogonal to each other.

Battery 120 is connected to starter 200 with relays RY1, RY2 controlled by ECU 300 being interposed. Battery 120 supplies a supply voltage for driving to starter 200 as relays RY1, RY2 are closed. It is noted that a negative electrode of battery 120 is connected to a body earth of vehicle 10.

Battery 120 is provided with a voltage sensor 125. Voltage sensor 125 detects an output voltage VB of battery 120 and outputs a detection value to ECU 300.

The voltage of battery 120 is supplied to ECU 300 and auxiliary machinery such as an inverter of an air-conditioning apparatus through DC/DC converter 127. DC/DC converter 127 is controlled by ECU 300 so as to maintain a voltage supplied to ECU 300 and the like. For example, in view of the fact that the voltage of battery 120 temporarily lowers as a result of drive of motor 220 for cranking engine 100, DC/DC converter 127 is controlled so as to raise the voltage when motor 220 is driven.

As will be described later, since motor 220 is controlled to be driven while a signal requesting start of engine 100 is output, DC/DC converter 127 is controlled to raise a voltage while the signal requesting start of engine 100 is output. A method of controlling DC/DC converter 127 is not limited thereto.

Relay RY1 has one end connected to a positive electrode of battery 120 and the other end connected to one end of solenoid 230 within starter 200. Relay RY1 is controlled by a control signal SE1 from ECU 300 so as to switch between supply and cut-off of a supply voltage from battery 120 to solenoid 230.

Relay RY2 has one end connected to the positive electrode of battery 120 and the other end connected to motor 220 within starter 200. Relay RY2 is controlled by a control signal SE2 from ECU 300 so as to switch between supply and cut-off of a supply voltage from battery 120 to motor 220. In addition, a voltage sensor 130 is provided in a power line connecting relay RY2 and motor 220 to each other. Voltage sensor 130 detects a motor voltage VM and outputs a detection value to ECU 300.

In the present embodiment, starter 200 includes a second gear that can be engaged with a first gear coupled to crankshaft 111 of engine 100, actuator 232 for moving the second gear to a position of engagement with the first gear in a driven state, and motor 220 for rotating the second gear. The "first gear" in the present embodiment is a ring gear 110 coupled to crankshaft 111 of engine 100, and the "second gear" is pinion gear 260.

As described above, supply of a supply voltage to motor 220 and solenoid 230 within starter 200 can independently be controlled by relays RY1, RY2.

Output member 250 is coupled to a rotation shaft of a rotor (not shown) within the motor, for example, by a straight spline or the like. In addition, pinion gear 260 is provided on an end portion of output member 250 opposite to motor 220. As relay RY2 is closed, the supply voltage is supplied from battery 120 so as to rotate motor 220. Then, output member 250 transmits the rotational operation of the rotor to pinion gear 260, to thereby rotate pinion gear 260.

As described above, solenoid 230 has one end connected to relay RY1 and the other end connected to the body earth. As relay RY1 is closed and solenoid 230 is excited, solenoid 230 attracts plunger 210 in a direction of arrow.

Plunger 210 is coupled to output member 250 with coupling portion 240 being interposed. As solenoid 230 is excited, plunger 210 is attracted in the direction of the arrow. Thus, coupling portion 240 of which fulcrum 245 is fixed moves output member 250 from a stand-by position shown in FIG. 1 in a direction reverse to a direction of operation of plunger 210, that is, a direction in which pinion gear 260 moves away from a main body of motor 220. In addition, biasing force reverse to the arrow in FIG. 1 is applied to plunger 210 by a not-shown spring mechanism, and when solenoid 230 is no longer excited, it returns to the stand-by position.

As output member 250 thus operates in an axial direction as a result of excitation of solenoid 230, pinion gear 260 is engaged with ring gear 110 provided around an outer circumference of a flywheel attached to crankshaft 111 of engine 100. Then, as pinion gear 260 performs a rotational operation while pinion gear 260 and ring gear 110 are engaged with each other, engine 100 is cranked and started.

Thus, in the present embodiment, actuator 232 for moving pinion gear 260 so as to be engaged with ring gear 110 provided around the outer circumference of the flywheel of engine 100 and motor 220 for rotating pinion gear 260 are individually controlled.

Though not shown in FIG. 1, a one-way clutch may be provided between output member 250 and the rotor shaft of motor 220 such that the rotor of motor 220 does not rotate due to the rotational operation of ring gear 110.

In addition, actuator 232 in FIG. 1 is not limited to the mechanism as above so long as it is a mechanism capable of transmitting rotation of pinion gear 260 to ring gear 110 and switching between a state that pinion gear 260 and ring gear 110 are engaged with each other and a state that they are not engaged with each other. For example, such a mechanism that pinion gear 260 and ring gear 110 are engaged with each other as a result of movement of the shaft of output member 250 in a radial direction of pinion gear 260 is also applicable.

ECU 300 includes a CPU (Central Processing Unit), a storage device, and an input/output buffer, none of which is shown, and receives input from each sensor or provides output of a control command to each piece of equipment. It is noted that control of these components is not limited to processing by software, and a part thereof may also be constructed by dedicated hardware (electronic circuitry) and processed.

ECU 300 receives a signal ACC indicating an amount of operation of an accelerator pedal 140 from a sensor (not shown) provided on accelerator pedal 140. ECU 300 receives a signal BRK indicating an amount of operation of a brake'pedal 150 from a sensor (not shown) provided on brake pedal 150. In addition, ECU 300 receives a start operation signal IG-ON issued in response to a driver's ignition operation or the like. Based on such information, ECU 300 generates a signal requesting start of engine 100 and a signal requesting stop thereof and outputs control signal SE1, SE2 in accordance therewith, so as to control an operation of starter 200.

ECU 300 can individually cause drive of each of actuator 232 and motor 220. In addition, ECU 300 has a rotation mode in which motor 220 is driven prior to drive of actuator 232 and an engagement mode in which actuator 232 is driven so as to engage pinion gear 260 and ring gear 110 with each other prior to drive of motor 220. In the present embodiment, ECU 300 makes transition to the engagement mode when the load of engine 100 fluctuates while the rotation mode is being executed.

Figure 2:
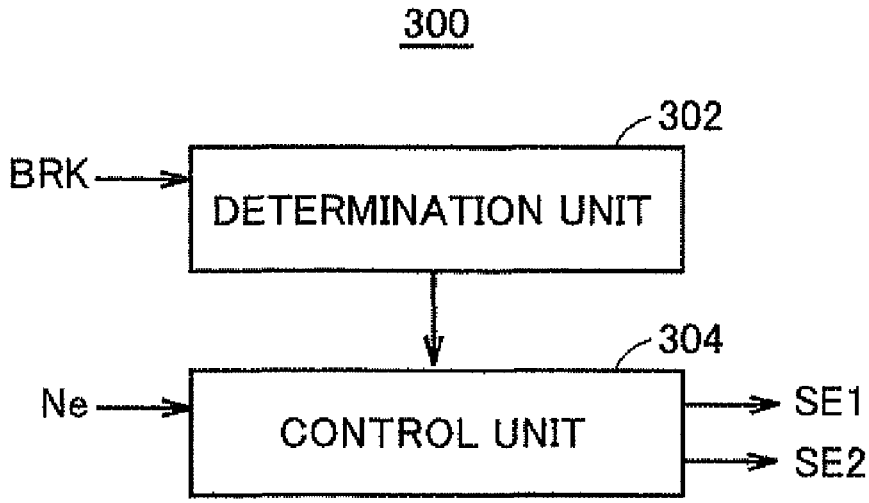
FIG. 2 is a functional block diagram of an ECU.

Referring to FIG. 2, a function of ECU 300 will be described. It is noted that a function of ECU 300 described below may be implemented by software or hardware or by cooperation of software and hardware.

ECU 300 includes a determination unit 302 and a control unit 304. Determination unit 302 determines whether start of engine 100 has been requested or not. For example, when an amount of operation of brake pedal 150 by the driver decreases to zero, determination unit 302 determines that start of engine 100 has been requested. More specifically, when the amount of operation of brake pedal 150 by the driver decreases to zero while engine 100 and vehicle 10 remain stopped, determination unit 302 determines that start of engine 100 has been requested. A method of determination as to whether or not start of engine 100 has been requested that is made by determination unit 302 is not limited thereto. When ECU 300 determines that start of engine 100 has been requested, ECU 300 generates a signal requesting start of engine 100 and outputs control signal SE1, SE2 in accordance therewith.

In the present embodiment, when a signal requesting start of engine 100 is generated, that is, when it is determined that start of engine 100 has been requested, control unit 304 controls actuator 232 and motor 220 so as to start engine 100, by selecting any one of a plurality of control modes based on speed Ne of engine 100. The plurality of control modes include a first mode in which actuator 232 and motor 220 are controlled such that pinion gear 260 starts rotation after pinion gear 260 moves toward ring gear 110 and a second mode in which actuator 232 and motor 220 are controlled such that pinion gear 260 moves toward ring gear 110 after pinion gear 260 starts rotation.

It is noted that, when it is determined that start of engine 100 has been requested, control unit 304 may control actuator 232 and motor 220 such that pinion gear 260 moves toward ring gear 110 after pinion gear 260 starts rotation, without selecting any one of the plurality of control modes.

When control unit 304 selected the first mode, control unit 304 controls actuator 232 such that pinion gear 260 moves toward ring gear 110 when determination unit 302 determined that start of engine 100 has been requested and control unit 304 controls motor 220 such that pinion gear 260 rotates after pinion gear 260 moved toward ring gear 110.

When control unit 304 selected the second mode, control unit 304 controls motor 220 such that pinion gear 260 starts rotation when determination unit 302 determined that start of engine 100 has been requested and control unit 304 controls actuator 232 such that pinion gear 260 moves toward ring gear 110 after pinion gear 260 started rotation.

When speed Ne of engine 100 is equal to or smaller than a first predetermined reference value $\alpha 1$, control unit 304 selects the first mode. When speed Ne of engine 100 is greater than first reference value $\alpha 1$, control unit 304 selects the second mode.

In addition, in the present embodiment, control unit 304 controls actuator 232 and motor 220 so as to start engine 100 by actuating actuator 232 such that pinion gear 260 moves toward ring gear 110 when a prediction condition that fluctuation of load of engine 100 is predicted is satisfied after start of actuation of motor 220 and before an estimation time point when it is estimated that rotation of ring gear 110 and rotation of pinion gear 260 are in synchronization with each other, while the rotation mode which will be described later is being executed. The prediction condition is a condition that a command for changing an actuated state of the equipment has been received. As described above, the "equipment" is equipment causing fluctuation of the load of engine 100 as a result of actuation, and in the present embodiment, it refers to clutch 112, transmission 114, alternator 132, and air-conditioner compressor 134.

In the present embodiment, the prediction condition includes a condition that a command for changing an actuated state of clutch 112 has been received. Specifically, the prediction condition includes a condition that an operation to change clutch 112 from the disengaged state to the engaged state has been received. Control unit 304 determines whether the prediction condition has been satisfied or not based on the detection value from the clutch pedal position sensor. For example, when control unit 304 detects the operation of clutch pedal 180 from a completely pressed-down state in a direction of releasing pressing-down through the clutch position sensor (for example, when output of the ON signal is stopped or when control unit 304 received the OFF signal), control unit 304 determines that the prediction condition has been satisfied assuming that the operation for changing clutch 112 from the disengaged state to the engaged state has been received.

Alternatively, the prediction condition includes a condition that a command for changing a transmitting state of transmission 114 has been received. Specifically, the prediction condition includes a condition that an operation for selecting a gear position of transmission 114 has been received. For example, when control unit 304 detects movement of shift lever 190 from the neutral position to a position corresponding to a predetermined gear position (for example, a first position) through the shift position sensor, control unit 304 determines that the prediction condition has been satisfied assuming that the operation for selecting the gear position of transmission 114 has been received.

Alternatively, the prediction condition includes a condition that any one command of a command for actuating alternator 132 (that is, for generating electric power) and a command for stopping actuation of alternator 132 has been received. For example, when a state of charge of the battery is lower than a lower limit value while alternator 132 is not actuated, control unit 304 determines that the prediction condition has been satisfied assuming that a command for actuating alternator 132 has been received. Alternatively, when a state of charge of the battery is higher than an upper limit value during actuation of alternator 132, control unit 304 determines that the prediction condition has been satisfied assuming that a command for stopping actuation of alternator 132 has been received.

Alternatively, the prediction condition includes a condition that any one command of a command for actuating air-conditioner compressor 134 and a command for stopping actuation has been received. For example, when a command for actuating cooling for automatically setting a temperature in a room to a prescribed temperature or a command for stopping actuation is received, control unit 304 may determine that the prediction condition has been satisfied, or alternatively, when the driver has performed an operation for actuating cooling or when the driver has performed an operation for stopping actuation of cooling, control unit 304 may determine that the prediction condition has been satisfied.

In the present embodiment, when any one prediction condition among a plurality of prediction conditions for each piece of equipment described above is satisfied, control unit 304 turns on a fluctuation prediction flag, and when none of the plurality of prediction conditions described above is satisfied, it turns off the fluctuation prediction flag.

[Description of Operation Mode of Starter]

Figure 3:
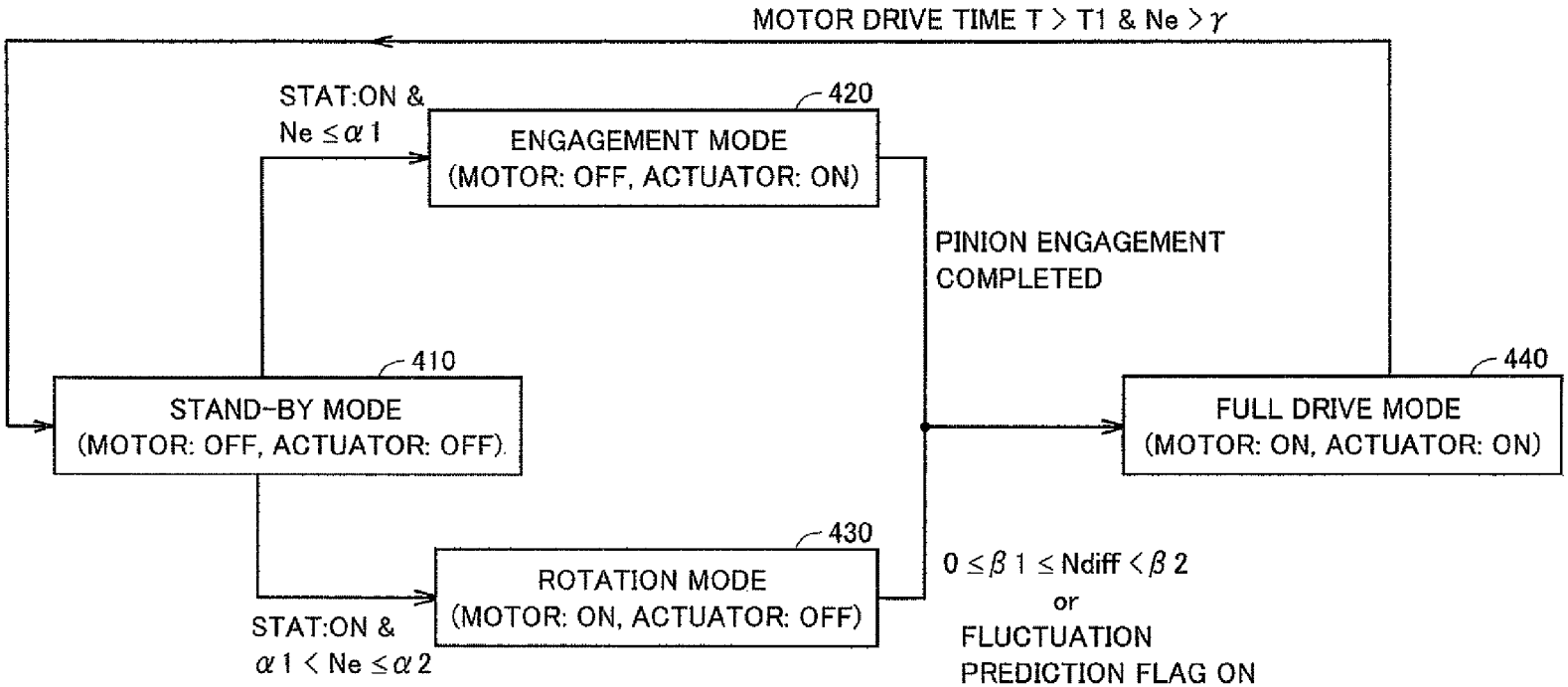
FIG. 3 is a diagram for illustrating transition of an operation mode of a starter.

FIG. 3 is a diagram for illustrating transition of an operation mode of starter 200 in the present embodiment. The operation mode of starter 200 in the present embodiment includes a stand-by mode 410, an engagement mode 420, a rotation mode 430, and a full drive mode 440.

The first mode described previously is a mode in which transition to full drive mode 440 is made via engagement mode 420. The second mode described previously is a mode in which transition to full drive mode 440 is made via rotation mode 430.

Stand-by mode 410 is a mode in which drive of both of actuator 232 and motor 220 in starter 200 is stopped, and it is a mode selected when start of engine 100 is not requested. Stand-by mode 410 corresponds to the initial state of starter 200, and it is selected when drive of starter 200 is not necessary, for example, before an operation to start engine 100, after completion of start of engine 100, failure in starting engine 100, and the like.

Full drive mode 440 is a mode in which both of actuator 232 and motor 220 in starter 200 are driven. When this full drive mode 440 is selected, motor 220 and actuator 232 are controlled such that pinion gear 260 rotates while pinion gear 260 and ring gear 110 are engaged with each other. Thus, engine 100 is actually cranked and the operation for start is started.

As described above, starter 200 in the present embodiment can independently drive each of actuator 232 and motor 220. Therefore, in a process of transition from stand-by mode 410 to full drive mode 440, there are a case where actuator 232 is driven prior to drive of motor 220 (that is, corresponding to engagement mode 420) and a case where motor 220 is driven prior to drive of actuator 232 (that is, corresponding to rotation mode 430).

Selection between these engagement mode 420 and rotation mode 430 is basically made based on speed Ne of engine 100 when re-start of engine 100 is requested.

Engagement mode 420 refers to a state where only actuator 232 out of actuator 232 and motor 220 is driven and motor 220 is not driven. This mode is selected when pinion gear 260 and ring gear 110 can be engaged with each other even while pinion gear 260 remains stopped. Specifically, while engine 100 remains stopped or while speed Ne of engine 100 is sufficiently low (Ne≦first reference value $\alpha 1$), this engagement mode 420 is selected.

After a signal requesting start of engine 100 is generated, engagement mode 420 is selected for actuator 232 and motor 220.

Then, after engagement mode 420 is selected as the operation mode, the operation mode makes transition from engagement mode 420 to full drive mode 440. Namely, full drive mode 440 is selected and actuator 232 and motor 220 are controlled. Namely, in the present embodiment, based on lapse of a predetermined period of time since start of drive of actuator 232, it is determined that engagement of pinion gear 260 and ring gear 110 with each other has been completed.

Meanwhile, rotation mode 430 refers to a state where only motor 220 out of actuator 232 and motor 220 is driven and actuator 232 is not driven. This mode is selected, for example, when a request for re-start of engine 100 is output immediately after stop of engine 100 is requested and when speed Ne of engine 100 is relatively high ($\alpha 1$<Ne≦second reference value $\alpha 2$).

When a signal requesting start of engine 100 is generated, actuator 232 and motor 220 are controlled in rotation mode 430.

Thus, when speed Ne of engine 100 is high, difference in speed between pinion gear 260 and ring gear 110 is great while pinion gear 260 remains stopped, and engagement between pinion gear 260 and ring gear 110 may become difficult. Therefore, in rotation mode 430, only motor 220 is driven prior to drive of actuator 232, so that speed Ne of ring gear 110 and a speed of pinion gear 260 are in synchronization with each other. Then, when it is determined that synchronization has been established in response to difference between speed Ne of ring gear 110 and the speed of pinion gear 260 being sufficiently small, actuator 232 is driven and ring gear 110 and pinion gear 260 are engaged with each other. Then, the operation mode makes transition from rotation mode 430 to full drive mode 440.

In the present embodiment, determination of establishment of synchronization is specifically made based on whether or not a relative speed Ndiff between speed Ne of engine 100 and a speed of pinion gear 260 (a speed Nm of motor 220 converted to a crankshaft speed) (=Ne−Nm) is in between prescribed threshold values ($0 \leqq \beta 1 \leqq Ndiff < \beta 2$). Though determination of establishment of synchronization may be made based on whether or not an absolute value of relative speed Ndiff is smaller than a threshold value β ($|Ndiff| < \beta$), engagement is more preferably carried out while speed Ne of engine 100 is higher than the speed of pinion gear 260.

In addition, in rotation mode 430, when the prediction condition described above is satisfied and a predicted fluctuation flag is turned on before an estimation time point when it is estimated that rotation of ring gear 110 and rotation of pinion gear 260 are in synchronization with each other, actuator 232 is driven and ring gear 110 and pinion gear 260 are engaged with each other even before the estimation time point. Then, the operation mode makes transition from rotation mode 430 to full drive mode 440.

In the case of full drive mode 440, the operation mode returns from full drive mode 440 to stand-by mode 410 in response to completion of start of engine 100 and start of a self-sustained operation of engine 100.

Thus, when a signal requesting start of engine 100 is output, that is, when it is determined that engine 100 is to be started, actuator 232 and motor 220 are controlled in any one mode of the first mode in which transition to full drive mode 440 is made via engagement mode 420 and the second mode in which transition to full drive mode 440 is made via rotation mode 430.

Figure 4:
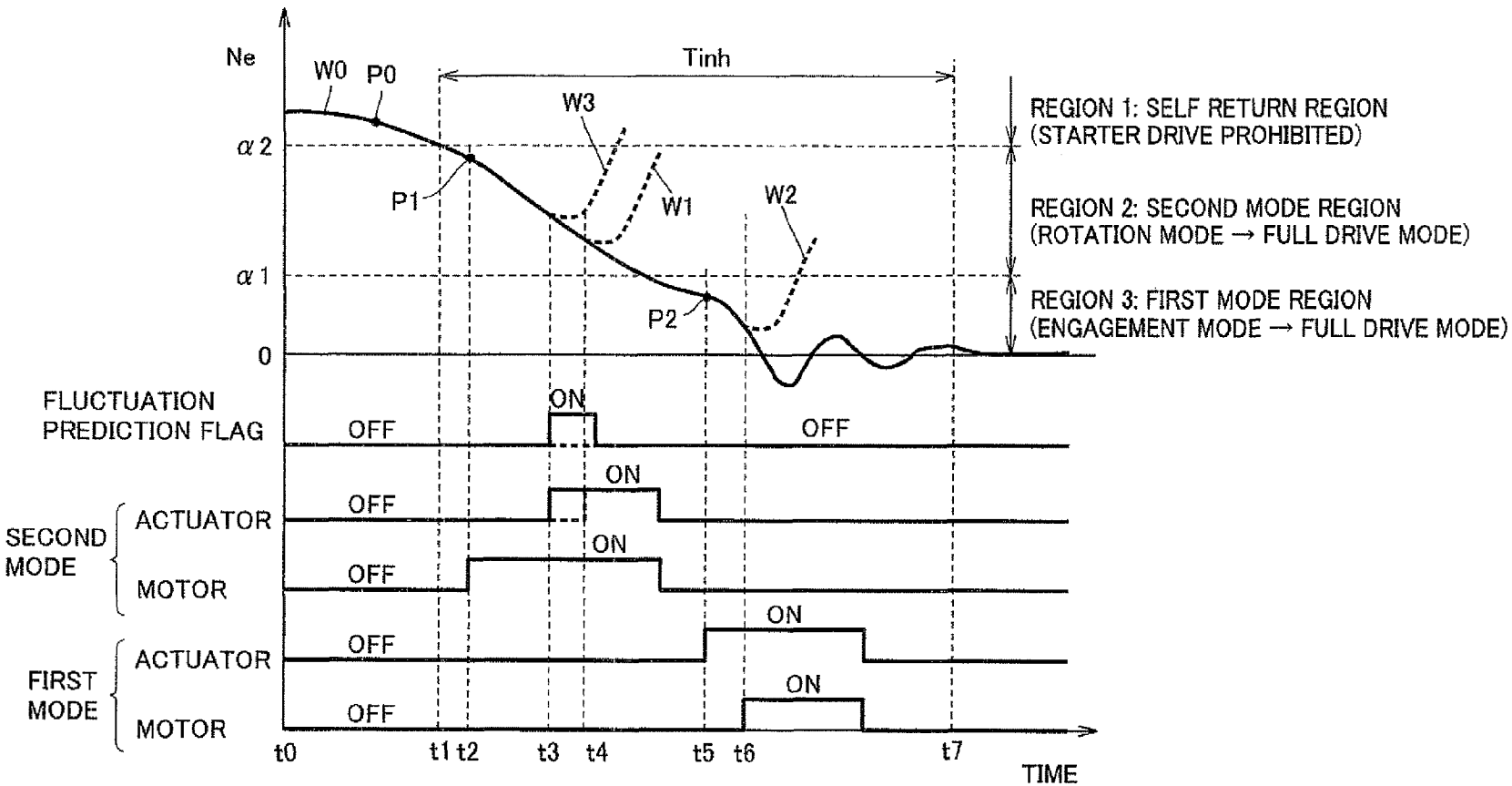
FIG. 4 is a diagram for illustrating a drive mode in an engine start operation.

FIG. 4 is a diagram for illustrating variation in engine start control and a fluctuation prediction flag in two drive modes (the first mode, the second mode) selected in an engine start operation in the present embodiment.

In FIG. 4, the abscissa indicates time and the ordinate indicates speed Ne of engine 100 and a state of drive of actuator 232 and motor 220 in the first mode and the second mode.

A case where, at a time t0, for example, a condition that vehicle 10 stops and the driver operates brake pedal 150 is satisfied and consequently a request to stop engine 100 is generated and combustion in engine 100 is stopped is assumed. Here, unless engine 100 is re-started, speed Ne of engine 100 gradually lowers as shown with a solid curve W0 and finally rotation of engine 100 stops.

Then, a case where, for example, an amount of the driver's operation of brake pedal 150 attains to zero while speed Ne of engine 100 is lowering, and thus a request to re-start engine 100 is generated is considered. Here, categorization into three regions based on speed Ne of engine 100 is made.

A first region (region 1) refers to a case where speed Ne of engine 100 is higher than second reference value α2, and for example, such a state that a request for re-start is generated at a point P0 in FIG. 4.

This region 1 is a region where engine 100 can be started by a fuel injection and ignition operation without using starter 200 because speed Ne of engine 100 is sufficiently high. Namely, it is a region where engine 100 can return by itself. Therefore, in region 1, drive of starter 200 is prohibited. It is noted that second reference value α2 described above may be restricted depending on a maximum speed of motor 220.

A second region (region 2) refers to a case where speed Ne of engine 100 is located between first reference value α1 and second reference value α2, and such a state that a request for re-start is generated at a point P1 in FIG. 4.

This region 2 is a region where speed Ne of engine 100 is relatively high, although engine 100 cannot return by itself. In this region, the rotation mode (the second mode) is selected as described with reference to FIG. 3.

When a request to re-start engine 100 is generated at a time t2, control unit 304 initially drives motor 220. Thus, pinion gear 260 starts to rotate.

As shown with a dashed line in FIG. 4, when an estimation time point at which it is estimated that rotation of ring gear 110 and rotation of pinion gear 260 are in synchronization with each other comes at a time t4 while the fluctuation prediction flag remains off, actuator 232 is driven. When actuator 232 is driven so that ring gear 110 and pinion gear 260 are engaged with each other at time t4, engine 100 is cranked and speed Ne of engine 100 increases as shown with a dashed curve W1. Thereafter, when engine 100 resumes the self-sustained operation, drive of actuator 232 and motor 220 is stopped.

Meanwhile, when the fluctuation prediction flag is turned on at a time t3 prior to time t4, for example, by release of pressing-down of clutch pedal 180, the fluctuation prediction flag is turned on and actuator 232 is driven. When actuator 232 is driven so that ring gear 110 and pinion gear 260 are engaged with each other at time t3, engine 100 is cranked and speed Ne of engine 100 increases as shown with a dashed curve W3. Thereafter, when engine 100 resumes the self-sustained operation, drive of actuator 232 and motor 220 is stopped.

A third region (region 3) refers to a case where speed Ne of engine 100 is lower than first reference value α1, and for example, such a state that a request for re-start is generated at a point P2 in FIG. 4.

This region 3 is a region where speed Ne of engine 100 is low and pinion gear 260 and ring gear 110 can be engaged with each other without synchronizing pinion gear 260. In this region, the engagement mode is selected as described with reference to FIG. 3.

When a request to re-start engine 100 is generated at a time t5, control unit 304 initially drives actuator 232. Thus, pinion gear 260 is pushed toward ring gear 110. At a time t6, when engagement between ring gear 110 and pinion gear 260 with each other is completed after drive of actuator 232, motor 220 is driven. Thus, engine 100 is cranked and speed Ne of engine 100 increases as shown with a dashed curve W2. Thereafter, when engine 100 resumes the self-sustained operation, drive of actuator 232 and motor 220 is stopped.

By thus controlling re-start of engine 100 by using starter 200 capable of independently driving actuator 232 and motor 220, engine 100 can be re-started in a shorter period of time than in a case of a conventional starter where an operation to re-start engine 100 was prohibited during a period (Tinh) from a speed at which return of engine 100 by itself was impossible (time t1 in FIG. 4) to stop of engine 100 (a time t7 in FIG. 4). Thus, the driver's uncomfortable feeling due to delayed re-start of the engine can be lessened.

[Description of Operation Mode Setting Control]

Figure 5:
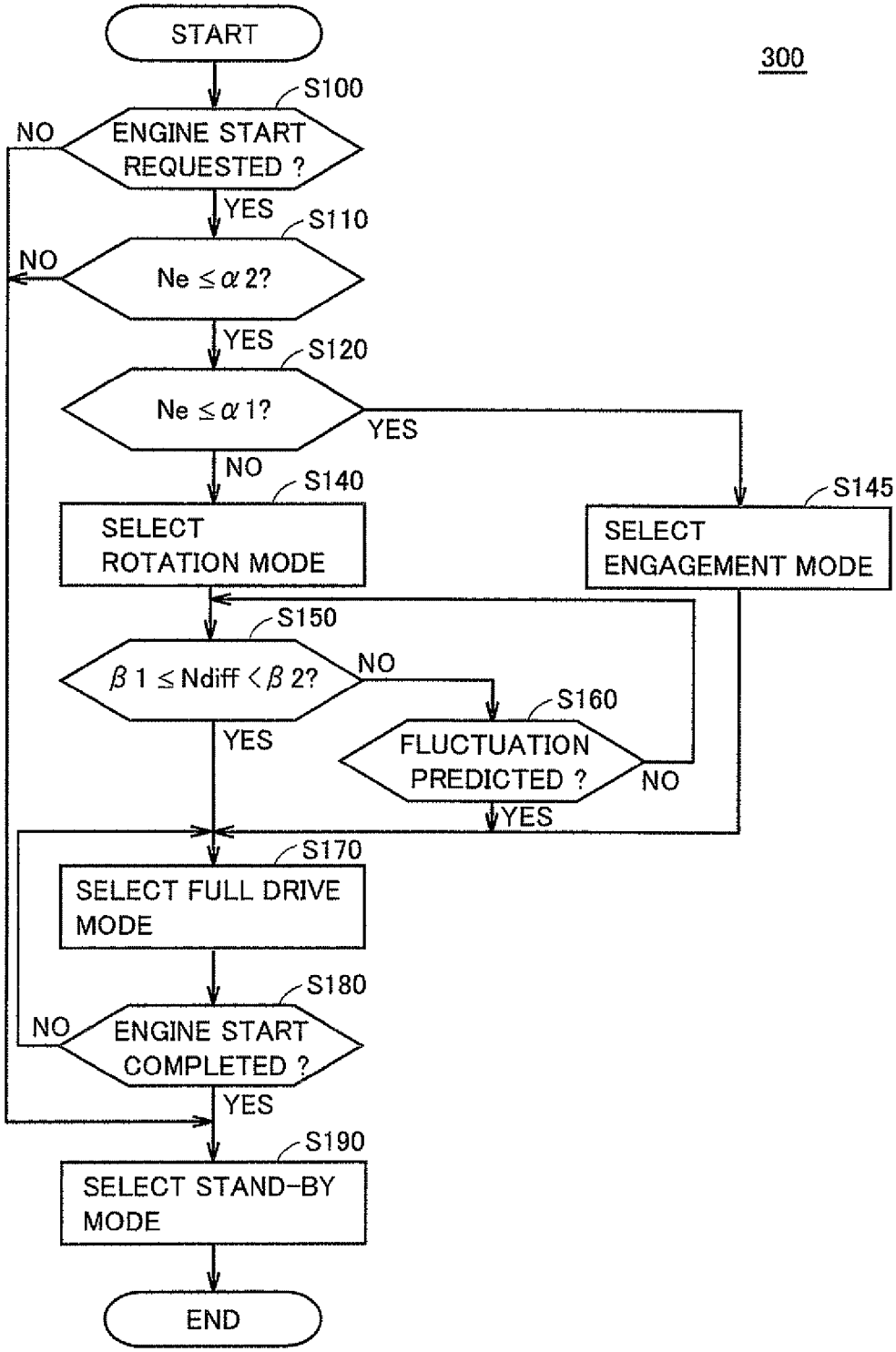
FIG. 5 is a flowchart showing a control structure of processing performed by the ECU in a first embodiment.

FIG. 5 is a flowchart for illustrating details of operation mode setting control processing performed by control unit 304 of ECU 300 in the present embodiment. The flowchart shown in FIG. 5 is realized by executing a program stored in advance in a memory of ECU 300 in a prescribed cycle. Alternatively, regarding some steps, processing can also be performed by constructing dedicated hardware (electronic circuitry).

Referring to FIGS. 1 and 5, in step (hereinafter the step being abbreviated as S) 100, control unit 304 determines whether start of engine 100 has been requested or not.

When start of engine 100 has not been requested (NO in S100), control unit 304 causes the process to proceed to S190 and selects the stand-by mode because an operation to start engine 100 is not necessary.

When start of engine 100 has been requested (YES in S100), the process proceeds to S110 and control unit 304 determines whether or not speed Ne of engine 100 is equal to or smaller than second reference value $\alpha 2$.

When speed Ne of engine 100 is greater than second reference value $\alpha 2$ (NO in S110), this case corresponds to region 1 in FIG. 4 where engine 100 can return by itself. Therefore, control unit 304 causes the process to proceed to S190 and selects the stand-by mode.

When speed Ne of engine 100 is equal to or smaller than second reference value $\alpha 2$ (YES in S110), control unit 304 determines whether or not speed Ne of engine 100 is equal to or smaller than first reference value $\alpha 1$.

When speed Ne of engine 100 is equal to or smaller than first reference value $\alpha 1$ (YES in S120), this case corresponds to region 3 in FIG. 4. Therefore, the process proceeds to S145 and control unit 304 selects the engagement mode. Control unit 304 outputs control signal SE1 so as to close relay RY1, and thus actuator 232 is driven. Here, motor 220 is not driven.

Thereafter, the process proceeds to S170 and control unit 304 selects the full drive mode. Then, starter 200 starts cranking of engine 100.

In S180, control unit 304 determines whether start of engine 100 has been completed or not, Determination of completion of start of engine 100 may be made, for example, based on whether or not the engine speed is greater than a threshold value $\gamma$ indicating the self-sustained operation after lapse of a prescribed period of time T1 since start of drive of motor 220.

When start of engine 100 has not been completed (NO in S180), the process returns to S170 and cranking of engine 100 is continued.

When start of engine 100 has been completed (YES in S180), the process proceeds to S190 and control unit 304 selects the stand-by mode.

On the other hand, when speed Ne of engine 100 is greater than first reference value $\alpha 1$ (NO in S120), the process proceeds to S140 and ECU 300 selects the rotation mode. Here, control unit 304 outputs control signal SE2 so as to close relay RY2, and thus motor 220 is driven. Here, actuator 232 is not driven.

Then, the process proceeds to S150, and control unit 304 determines whether or not difference Ndiff between speed Ne of ring gear 110 and speed Nm of motor 220 converted to a crankshaft speed (the speed of pinion gear 260) (=Ne−Nm) is equal to or greater than a predetermined value $\beta 1$ and smaller than a predetermined value $\beta 2$. When Ndiff is equal to or greater than predetermined value $\beta 1$ and smaller than predetermined value $\beta 2$ (YES in S150), the process proceeds to S170. Otherwise (NO in S150), the process moves to S160.

In S160, control unit 304 determines whether fluctuation is predicted or not. Specifically, it is determined that fluctuation is predicted when any one of the plurality of prediction conditions for each piece of equipment described above is satisfied. Here, control unit 304 turns on a fluctuation prediction determination flag. On the other hand, when none of the plurality of prediction conditions described above is satisfied, determination that fluctuation is not predicted is made. When determination that fluctuation is predicted is made (YES in S160), the process moves to S170. Otherwise, (NO in S160), the process moves to S150.

Then, ECU 300 selects the full drive mode in S170. Thus, actuator 232 is driven, pinion gear 260 and ring gear 110 are engaged with each other, and engine 100 is cranked.

As described above, in the present embodiment, when the rotation mode is selected in response to a request to start engine 100 and when a condition that fluctuation of the load of engine 100 is predicted is satisfied before the estimation time point at which it is estimated that rotation of ring gear 110 and rotation of pinion gear 260 are in synchronization with each other, actuator 232 is driven so as to engage ring gear 110 and pinion gear 260 with each other. Thus, even when speed Ne of engine 100 suddenly fluctuates, engine 100 can quickly be started and hence deterioration in starting capability can be suppressed. Therefore, an engine starting device and an engine starting method for suppressing deterioration in engine starting capability can be provided.

For example, when speed Ne of engine 100 suddenly decreases while the rotation mode is being executed, the speed of ring gear 110 may become smaller than the speed of pinion gear 260 in spite of drive of actuator 232 at the estimation time point. Here, rotation of ring gear 110 decreases and rotation of pinion gear 260 increases. Therefore, rotation of ring gear 110 and rotation of pinion gear 260 cannot be in synchronization with each other. Consequently, engagement between ring gear 110 and pinion gear 260 cannot be achieved and engine 100 cannot be started.

Meanwhile, by driving actuator 232 at the time point when the prediction condition that load of engine 100 fluctuates is satisfied, even when speed Ne of engine 100 suddenly decreases due to fluctuation of load, actuator 232 can be driven while the speed of ring gear 110 is greater than the speed of pinion gear 260 (namely, while ring gear 110 and pinion gear 260 can be engaged with each other). Therefore, when ring gear 110 and pinion gear 260 are engaged with each other, engine 100 can quickly be started.

Second Embodiment

An engine starting device according to a second embodiment will be described hereinafter. The engine starting device according to the present embodiment is different from the engine starting device according to the first embodiment described above in an operation of control unit 304, but features thereof are otherwise the same as those of the engine starting device according to the first embodiment described above and hence the same reference characters are allotted thereto. Functions thereof are also identical. Therefore, detailed description thereof will not be repeated here.

In the present embodiment, control unit 304 controls actuator 232 and motor 220 so as to start engine 100 by actuating actuator 232 such that pinion gear 260 is moved toward ring gear 110 when load of engine 100 fluctuates after start of actuation of motor 220 and before the estimation time point at which it is estimated that rotation of ring gear 110 and rotation of pinion gear 260 are in synchronization with each other, while the rotation mode is being executed.

Control unit 304 determines whether load of engine 100 fluctuates or not based on speed Ne of engine 100, an amount of intake air, a throttle position, or an amount of operation of clutch pedal 180. For example, control unit 304 may calculate an amount of change over time of at least any one of speed Ne of engine 100, an amount of intake air and a throttle position, and then determine that load of engine 100 fluctuated when variation equal to or greater than a threshold value was observed as compared with the previously calculated amount of change over time, or determine that load of engine 100 fluctuated when an amount of operation of clutch pedal 180 attains to an amount of operation at which clutch 112 starts to engage.

The operation mode of starter 200 in the present embodiment is different from the operation mode of the starter described with reference to FIG. 3 in the first embodiment in that a condition for transition from rotation mode 430 to full drive mode 440 is a condition that rotation of ring gear 110 and rotation of pinion gear 260 are in synchronization with each other or a condition that it was determined that load of engine 100 fluctuated. Since the operation mode of starter 200 is otherwise similar, detailed description thereof will not be repeated.

Figure 6:
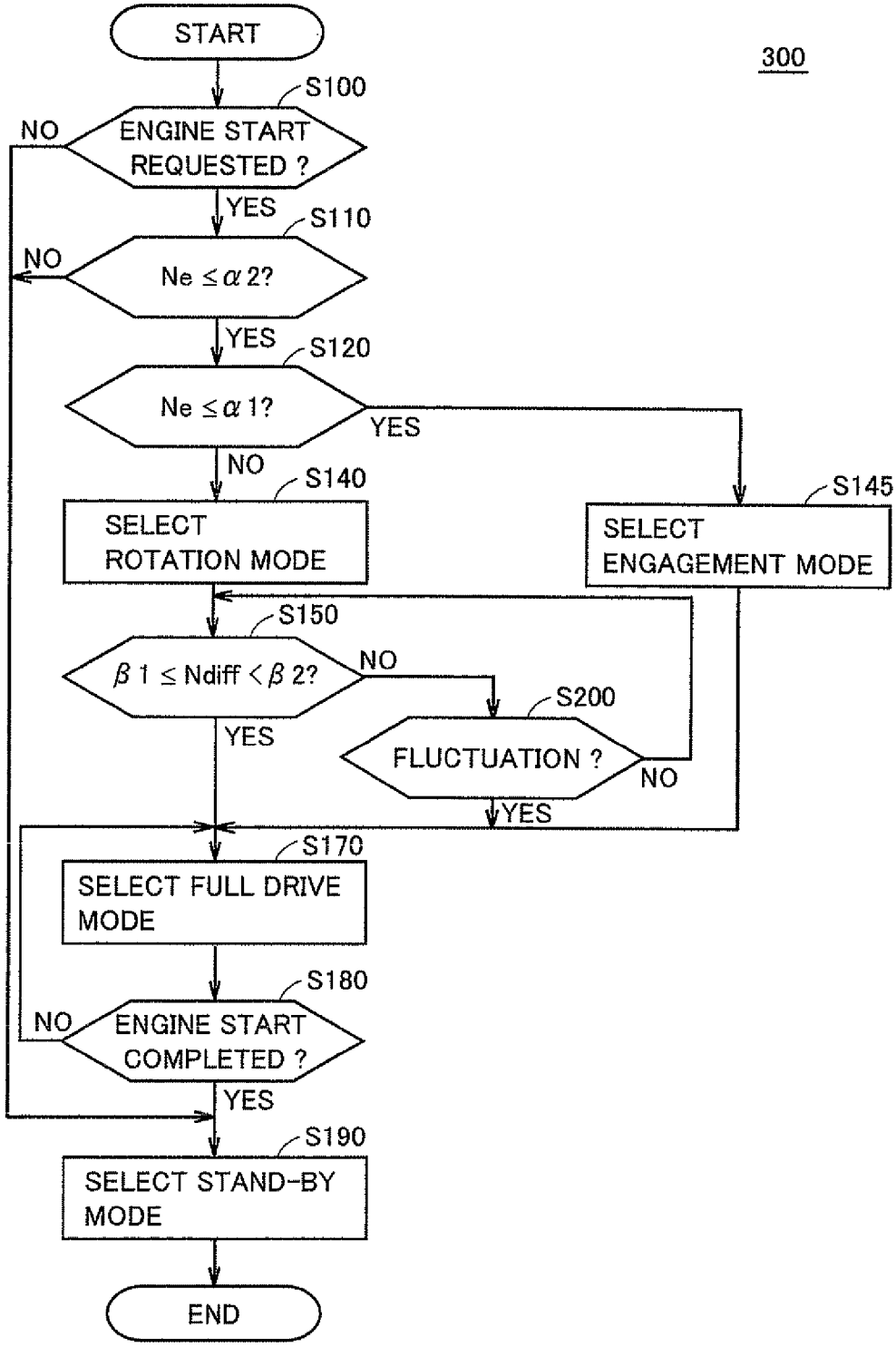
FIG. 6 is a flowchart showing a control structure of processing performed by the ECU in a second embodiment.

FIG. 6 is a flowchart for illustrating details of operation mode setting control processing performed by control unit 304 of ECU 300 in the present embodiment. It is noted that the processing in the flowchart shown in FIG. 6 the same as that shown in FIG. 5 described previously has the same step number allotted and the processing therein is also identical. Therefore, detailed description thereof will not be repeated here.

In S150, when Ndiff is determined as smaller than predetermined value β1 or equal to or greater than predetermined value β2 (NO in S150), control unit 304 determines in S200 whether or not load of engine 100 fluctuates or not. When it is determined that load fluctuates (YES in S200), the process moves to S170. Otherwise (NO in S200), the process moves to S150.

As described above, in the present embodiment, when the rotation mode is selected in response to a request to start engine 100 and when the load of engine 100 fluctuates before the estimation time point at which it is estimated that rotation of ring gear 110 and rotation of pinion gear 260 are in synchronization with each other, actuator 232 is driven so as to engage ring gear 110 and pinion gear 260 with each other. Thus, even when speed Ne of engine 100 suddenly fluctuates, engine 100 can quickly be started and hence deterioration in starting capability can be suppressed. Therefore, an engine starting device and an engine starting method for suppressing deterioration in engine starting capability can be provided.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An engine starting device, comprising:

a starter for starting an engine; and a control device for said starter, said starter including a second gear that can be engaged with a first gear coupled to a crankshaft of said engine, an actuator for moving said second gear to a position of engagement with said first gear in a driven state, and a motor for rotating said second gear, said control device being capable of individually drive each of said actuator and said motor, said control device having a rotation mode in which said motor is driven prior to drive of said actuator and an engagement mode in which said actuator is driven so as to engage said second gear with said first gear prior to drive of said motor, and said control device making transition to said engagement mode when load of said engine fluctuates while said rotation mode is being executed.

2. The engine starting device according to claim 1, wherein said control device drives said actuator when the load of said engine fluctuates after start of actuation of said motor and before an estimation time point when it is estimated that rotation of said first gear and rotation of said second gear are in synchronization with each other, while said rotation mode is being executed.

3. The engine starting device according to claim 1, wherein said control device drives said actuator when a prediction condition that fluctuation of a rotation speed of said engine is predicted is satisfied after start of actuation of said motor and before an estimation time point when it is estimated that rotation of said first gear and rotation of said second gear are in synchronization with each other, while said rotation mode is being executed.

4. The engine starting device according to claim 3, wherein equipment causing fluctuation of the load of said engine as a result of actuation is coupled to said crankshaft of said engine, and said prediction condition is a condition that a command for changing an actuated state of said equipment has been received.

5. The engine starting device according to claim 4, wherein said equipment is a clutch, and said prediction condition is a condition that a command for changing an actuated state of said clutch has been received.

6. The engine starting device according to claim 5, wherein said prediction condition is a condition that an operation for changing said clutch from a disengaged state to an engaged state has been received.

7. The engine starting device according to claim 4, wherein said equipment is a transmission, and said prediction condition is a condition that a command for changing a transmitting state of said transmission has been received.

8. The engine starting device according to claim 7, wherein said prediction condition is a condition that an operation for selecting a gear position of said transmission has been received.

9. The engine starting device according to claim 4, wherein said equipment is an alternator, and said prediction condition is a condition that any one command of a command for actuating said alternator and a command for stopping actuation of said alternator has been received.

10. The engine starting device according to claim 4, wherein said equipment is an air-conditioner compressor, and said prediction condition is a condition that any one command of a command for actuating said air-conditioner compressor and a command for stopping actuation of said air-conditioner compressor has been received.

11. The engine starting device according to claim 1, wherein said control device controls said actuator and said motor such that said engine starts, with any one of said rotation mode and said engagement mode being selected based on a rotation speed of said engine.

12. An engine starting method, an engine being provided with a starter for starting said engine and a control device for said starter, said starter including a second gear that can be engaged with a first gear coupled to a crankshaft of said engine, an actuator for moving said second gear to a position of engagement with said first gear in a driven state, and a motor for rotating said second gear, each of said actuator and said motor being able to individually be driven, comprising the steps of:

driving said actuator and said motor in a rotation mode in which said motor is driven prior to drive of said actuator;

driving said actuator and said motor in an engagement mode in which said actuator is driven so as to engage said second gear with said first gear prior to drive of said motor; and making transition to said engagement mode when load of said engine fluctuates while said rotation mode is being executed.

* * * * *